US005480279A

United States Patent [19]

Stauber

[11] Patent Number: 5,480,279

[45] Date of Patent: Jan. 2, 1996

[54] GRIPPER FOR HANDLING AND STORING PRODUCTS IN ROLL FORM

[75] Inventor: Hans-Ulrich Stauber, Grüt, Switzerland

[73] Assignee: SFT AG Spontanfördertechnik, Weinfelden, Switzerland

[21] Appl. No.: 337,079

[22] Filed: Nov. 10, 1994

Related U.S. Application Data

[63] Continuation-in-part of Ser. No. 870,323, Apr. 17, 1992, abandoned.

[30] Foreign Application Priority Data

Apr. 18, 1991 [CH] Switzerland ..... 01163/91

[51] Int. Cl.[6] ..... B65G 59/02

[52] U.S. Cl. ..... 414/792.9; 414/266; 414/908; 414/911; 414/626; 414/795.9; 414/744.3; 414/922; 901/46; 901/16; 242/159; 242/915; 294/902; 294/119.2; 294/93; 294/103.2

[58] Field of Search ..... 414/795.9, 796.9, 414/744.3, 922, 626, 416, 403, 785, 911, 908, 910, 266, 797.1, 797, 788.1, 792.9; 901/39, 46, 47, 16; 294/902, 88, 97, 93, 94, 95, 96, 103.2, 119.1; 242/159, 915

[56] References Cited

U.S. PATENT DOCUMENTS

| | | | |
|---|---|---|---|
| 2,574,131 | 11/1951 | Steinbrecher | 294/62 |
| 3,064,855 | 11/1962 | Fischer | 220/66 |
| 3,253,995 | 5/1966 | Antonsen et al. | 176/30 |
| 3,831,992 | 8/1974 | Francois | 294/65 |
| 4,041,686 | 8/1977 | Inaba et al. | 57/34 R |
| 4,131,206 | 12/1978 | Kawada et al. . | |
| 4,615,493 | 10/1986 | Teranishi et al. . | |
| 4,723,884 | 2/1988 | Brinker et al. . | |
| 4,783,021 | 11/1988 | Nagasawa . | |
| 4,924,999 | 5/1990 | Kikuchi et al. | 198/409 |
| 5,000,231 | 3/1991 | Takehana et al. | 139/450 |

FOREIGN PATENT DOCUMENTS

| | | |
|---|---|---|
| 214352 | 10/1984 | German Dem. Rep. . |
| 1481826 | 10/1969 | Germany . |
| 3405138 | 8/1985 | Germany . |
| 3518901 | 1/1987 | Germany . |
| 1110733 | 8/1984 | U.S.S.R. . |
| 1315228 | 6/1987 | U.S.S.R. . |

*Primary Examiner*—Frank E. Werner
*Attorney, Agent, or Firm*—Walter C. Farley

[57] ABSTRACT

A gripper for handling printed product rolls and empty roll cores is used for intermittently storing printed products wound on roll cores. The gripper has a central piece (10), which is fixed to a conveying or transporting device and which carries a gripper arm star or spider (20). On the gripper arm star (20) is a substantially circular array of radially movable roll clamping devices (30) for clamping a roll or rolls (W) from the periphery thereof and core supports (40) for engaging and supporting a rosette-shaped arrangement of juxtaposed roll cores (WK). The core supports (40) are pivotable so that, in a core handling configuration of the gripper, they are positioned within the circle formed by the roll clamping devices and in a roll handling configuration of the gripper they are moved out of that circle. The movements of the gripper parts are driven by linear drives and monitored by sensors, so that the gripper can operate in a fully automated manner.

9 Claims, 4 Drawing Sheets

GRIPPER FOR HANDLING AND STORING PRODUCTS IN ROLL FORM

CROSS-REFERENCE TO RELATED APPLICATION

This is a continuation-in-part of application Ser. No. 07/870,323 filed Apr. 17, 1992 and now abandoned.

FIELD OF THE INVENTION

This invention is in the field of storage technology and relates to a gripper for the purpose of handling products in roll form in order to take them to a store and for removing them from the store, particularly for handling printed products in roll form.

BACKGROUND OF THE INVENTION

Printed products frequently have to be intermediately stored and rearranged between processing stages, because often a processing stage supplies an intermediate product with a speed and a sequence not coinciding with the speed and sequence of the next processing stage. For the intermediate storage of printed products, which arrive in scale flow form and which are to be further processed as a scale flow, storage systems are known in which the scale flows are shaped into either rods or rolls and stored in this form. Storage in roll form has proved to be advantageous because the scale flow formation is retained, because for storage purposes the rolls merely have to be superimposed, because no storage aids other than the roll cores or hubs are required and because the winding and unwinding can be completely automated.

For intermediate storage and rearrangement, the scale flows provided by a processing stage are wound onto roll cores or hubs and the thus-formed rolls are stored. When needed, the rolls are removed from the store and unwound. The roll cores, which are equipped with an integrated band, are consumed in the process of winding up, pass with the roll into the store and are made available again after unwinding. Between the time that the cores are made available on unwinding and their use or re-use on winding, it is also necessary to intermediately store the empty roll cores.

European application no. 92810181.5 (published as no. 505320) describes a method for the intermediate storage and rearrangement of printed products in scale flow form in which, for optimum utilization of the storage space, both the printed product rolls and the empty roll cores are stored interchangeably. For this reason, the rolls are stored with vertical winding axes, stacked on top of each other and the roll cores are juxtaposed with parallel, vertical winding axes to form substantially circular, rosette-shaped arrangements, which arrangements have substantially the same diameters as the diameter of the usual roll. For optimum utilization of equipment and for economizing on transportation, the equipment used for carrying out the described method, i.e., for handling and transporting rolls and cores, is advantageously so designed that it can not only handle and transport single rolls and single empty cores, but can also handle either a plurality of superimposed rolls or a rosette-shaped arrangement of a plurality of empty cores.

SUMMARY OF THE INVENTION

For handling and storing rolls (in the form of a superimposed plurality of rolls or individually) and empty roll cores or hubs (as a rosette-shaped arrangement of juxtaposed cores or individually), an object of the invention is consequently to provide a gripper enabling the following two kinds of actions to be performed:

(1) gripping a single roll or a plurality of superimposed rolls and depositing same with vertical winding axes at a store (storage location) on a stack of similar rolls or on a floor, if necessary between higher stacks, or vice versa, i.e., gripping them in the store and depositing them elsewhere; and (2) gripping a rosette-shaped arrangement of roll cores, or part of a rosette, and placing it in the store on a stack of rolls or roll core rosettes or on the floor, if necessary between higher stacks, or vice versa, i.e., gripping them in the store and depositing them elsewhere.

The operation of the gripper must be controllable by a central intelligence, as must its conversion from a configuration for handling rolls to a configuration for handling roll cores and back again. For conveying rolls or cores between gripping and deposit, the gripper must be useable in combination with a suitable conveying means, such as a travelling crane or a vehicle.

A plurality of substantially hollow cylindrical roll cores, the gripper and the conveying means together form a system for storing products in roll form. The inventive gripper and the roll cores are adapted to each other such that the gripper is able to handle either (a) one or more rolls, or (b) a rosette-shaped arrangement consisting of a plurality of juxtaposed roll cores, or (c) a rosette-shaped arrangement of juxtaposed cylinders each consisting of a plurality of superimposed roll cores or parts of such arrangements. The diameter d of an empty roll core D and the diameter of the largest possible printed product roll grippable by the gripper are such that there exists a rosette-shaped arrangement of several juxtaposed empty roll cores (with vertical winding axes), wherein the external diameter of this rosette-shaped arrangement is equal to or smaller than the diameter D of the largest possible roll (FIG. 1). The roll core is essentially constructed as a hollow cylinder with holding means located in its interior where it can be gripped by the gripper. Circular end faces of each roll core are advantageously constructed in such a way that several roll cores can be stacked upon one another in a stable manner.

The inventive gripper is essentially constructed as a star having, e.g., six arms or rays whose symmetry is adapted to the symmetry of the closest juxtaposed stacks of rolls with equal circular ground plans, i.e. the angles between the gripper arms are either 60° or a multiple of 60°. The gripper arms only extend over the external diameter of the largest grippable roll in such a way that the gripper can move vertically to a lower such stack between higher ones. The gripper has on the arms clamping means with which it can clamp at least one roll by its periphery and advantageously also has inner roll supporting means with which it supports the roll core of the clamped roll. Within the clamping means, i.e. within the area in which a clamped roll is positioned, it also has core supporting means located in a circle for gripping and carrying a substantially circular, rosette-shaped arrangement of individual, empty roll cores or of superimposed roll cores. The core supporting means are movably arranged on the gripper arms or on intermediate arms in such a way that they can be moved out of the way of a roll or rolls to be gripped.

The conveying means and the gripper are designed for storage work in such a way that, at least in the store, the gripper grips from above rolls with vertical winding axes and deposits rolls in the same position. Gripping and depositing outside the store may include rotation of the gripper with or without a roll or rolls from a horizontal into a vertical position (i.e., from an axis-vertical to an axis-horizontal position), for which the conveying means or the connection between conveying means and gripper are designed accordingly. Such an apparatus can then also be used for changing or replacing rolls at the winding stations or on corresponding roll changer frames.

BRIEF DESCRIPTION OF THE DRAWINGS

The inventive gripper is described in greater detail hereinafter with reference to the following drawings, wherein.

DESCRIPTION OF THE PREFERRED EMBODIMENTS

Figure 1:
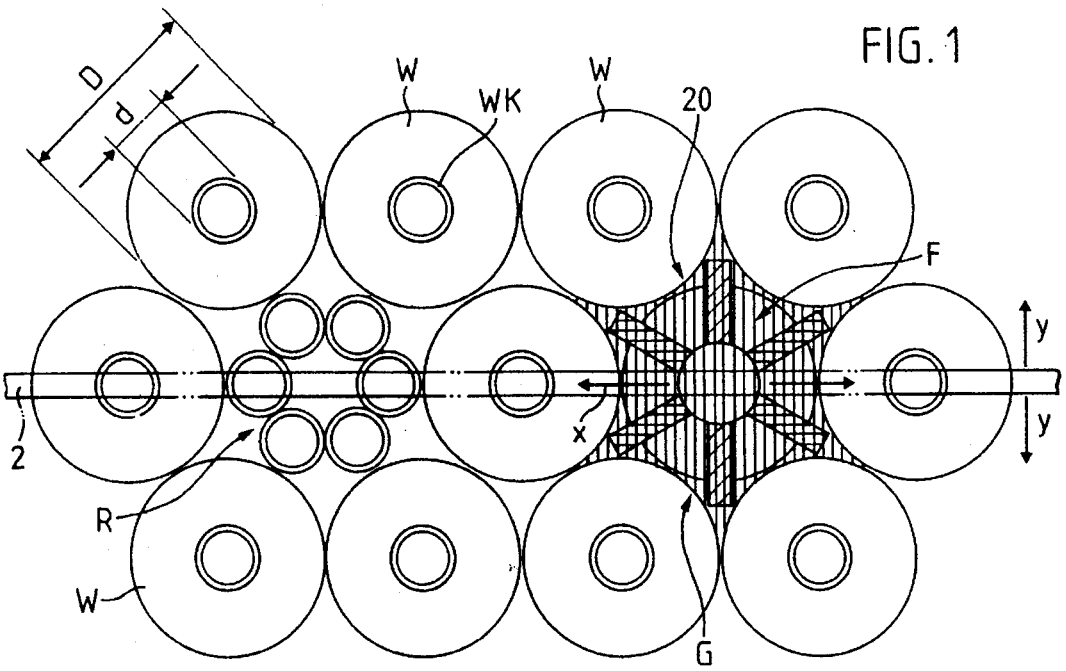
FIG. 1 is a top plan view of a typical storage area in which and from which printed product rolls and roll cores can be placed and taken by the inventive gripper.

FIG. 1 shows a detail of a top plan view of a store in which rolls W and roll core rosettes R are stored interchangeably in closely juxtaposed stack form and can be introduced into and removed from above by means of an inventive gripper G combined with a suitable conveying means. Rolls W and roll core rosettes R are stored in stacks in such a way that the storage locations for the rolls W and the roll core rosettes R can be interchanged at random and in such a way that the storage space is subject to optimum utilization. These two conditions lead to a storage arrangement with densely packed, circular storage locations, which in each case have the diameter D of the largest possible roll. For optimum utilization reasons the stored rolls normally have this maximum diameter D. Smaller diameter rolls can also be stored, provided that they do not prejudice the stack stability. Such a very compact arrangement gives, for a stack located between other stacks, six contact points with the other stacks and a free space F in the form of a six-arm star (singly hatched area). If a gripper is to grip rolls closely stored in this way from the periphery thereof, it must be able to grip in the six substantially triangular spaces arranged around a roll, i.e. in a plan view from above, the gripper must project over a roll by at the most these six triangles. This leads to grippers G with a star or spider of gripper arms (shown as doubly hatched rectangles) with intermediate angles of 60°, 120° or 180°. Advantageous shapes for the star of gripper arms are consequently six arms with intermediate angles of 60°, four arms with intermediate angels of 60° and 120°, or three arms with intermediate angles of 120°. Two arms with intermediate angles of 180° are also conceivable, but particularly in the case of heavy rolls do not lead to adequate stability of the gripped roll, partly because the width of the clamping jaws is restricted by the dimensions of the triangular free spaces.

It can also be gathered that the conveying means guiding the gripper from storage location to storage location, as well as the gripper itself, must move in such a way that there is no change to the gripper rotation position relative to the store arrangement (rotation within the paper plane of the Figure), because the free spaces around each stack are oriented in the same way. This is advantageously achieved by a conveying means which has an unchangeable rotational orientation and on which the gripper is non-rotatably attached (at least regarding rotation around its own rotation axis). The conveying means is appropriately constituted by a store vehicle guided on rails positioned along a narrow gap or gorge to service the store with an arm extendable perpendicular to the rail or, as indicated in FIG. 1, a travelling crane with a rail 2 e.g. displaceable in the y-direction and a support running thereon in the x-direction, on which the gripper G is fixed in a non-rotatable manner (at least as to rotation around the rotation axis of the gripper).

FIG. 1 shows a rosette-shaped arrangement R consisting of six juxtaposed roll cores or six juxtaposed cylinders each consisting of the same number of superimposed roll cores. Instead of this specific rosette-shaped arrangement other such arrangements are imaginable: e.g. at least three cores whose rotation axes are arranged substantially in a circle whereby one or more additional cores can be arranged in the middle of such a circle.

Figure 2:
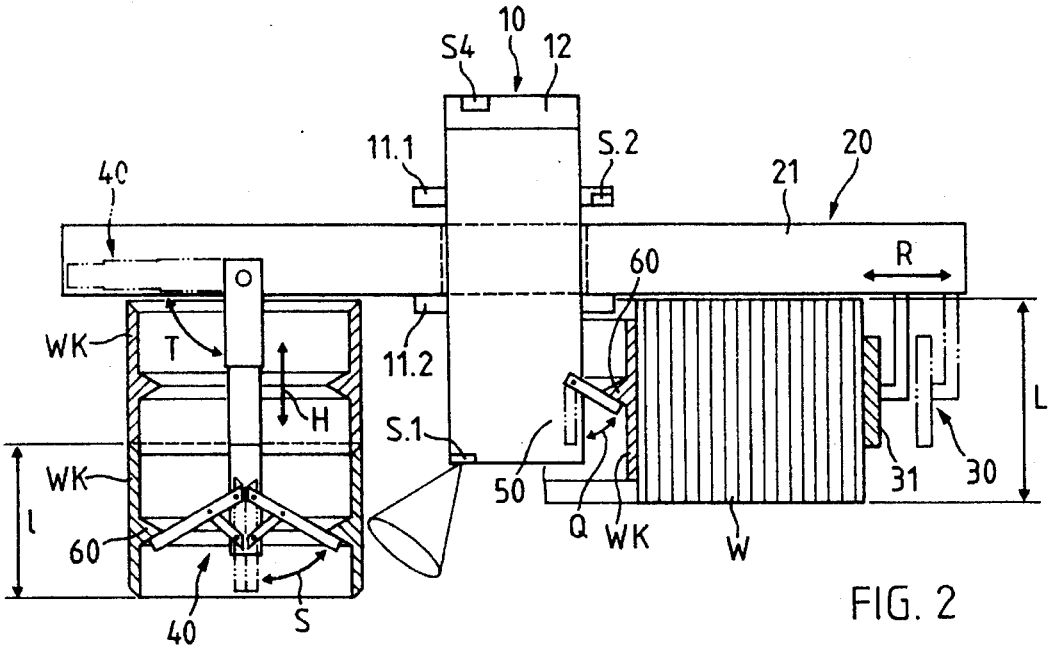
FIG. 2 is a schematic side elevation of a first embodiment of a gripper according to the invention, in section along the rotation axes of a gripped pair of superimposed cores (left hand side of the Figure) and of a gripped roll (half of which is drawn in the right hand half of the Figure)

FIG. 2 shows a first embodiment of the inventive gripper as a section along the rotation axis of a superimposed pair of gripped cores WK (left hand side of the Figure) and of a gripped roll W (half of which is shown on the right hand side of the Figure). On the right hand side of FIG. 2 one of a plurality (e.g. six) of clamping means 30 is shown for clamping the roll W along its diameter, and on the left hand side is shown one of a plurality (e.g. six) of core supporting means 40 for gripping roll cores WK. The gripper further features a central piece 10 and the aforementioned gripper arm star or spider 20. It is advantageous for the gripper arm star 20 to be arranged so as to be axially movable to a limited extent, e.g. between the two stops 11.1 and 11.2 on central piece 10. Central piece 10 has fixing means 12 enabling the gripper to be fixed to the conveying means and connections for power means, which are required for the movement of the gripper parts and the controls and checking thereof.

The gripper arm star 20, whose construction has already been described in conjunction with FIG. 1, has gripper arms 21, which extend above the outer circumference of a roll W to be gripped. At their ends the gripper arms 21 carry clamping means 30 one of which is shown on the right side of FIG. 2. The gripper arms can also carry core supporting means 40, one of which is shown on the left side of FIG. 2, but the core supporting means can also be mounted symmetrically on intermediate arms between gripper arms 21.

Each clamping means 30 is driven by a suitable drive, which is e.g. placed in each gripper arm 21 (not shown in the drawing), for radial movement (arrow R) between a radius which is somewhat larger than the radius of the largest possible roll and the radius of the smallest possible roll. The drive for this movement is such that it can exert compressive forces on the gripped roll for securing the latter. The drives for the clamping means 30 are coordinated so that the clamping means are always arranged substantially in a circle. Each clamping means 30 has at least one curved clamping jaw 31. If the gripper is to grip several superimposed rolls, it is advantageous to equip the clamping means 30 with a corresponding number of jaws. In conjunction with FIGS. 3 and 4 a clamping means for two superimposed rolls will be described and the clamping jaws are so interconnected by means of a tilting device, that it is possible to grip therewith two rolls with diameters differing within a given range.

Roll supporting means 50 for stabilizing a gripped roll can be provided on the central piece 10, whose lower part is located in the interior of the core of a gripped roll. These supporting means operate in conjunction with holding means 60 in the core interior, which partly reduce the internal diameter of a roll core. The roll supporting means 50 are connected to a drive (not shown) so as to be moveable as indicated by arrow Q, thereby increasing or decreasing the effective external diameter of central piece 10. For gripping a roll, the central piece 10 with the roll supporting means in an inner position is moved into the core of the roll and then the roll supporting means 50 are moved outward to engage holding means 60 on the inside of the core, thereby supporting the roll. If several superimposed rolls W are to be gripped simultaneously, it is desirable to provide roll supporting means 50 for each roll at corresponding heights of the central piece 10. They are heightwise arranged so that with the gripper arm star 20 resting on the lower stop 11.2 the means 50 are located below the holding means 60 of the corresponding roll cores WK such that they can also carry part of the roll weight.

The core supporting means 40 also operate in conjunction with the roll core holding means 60 of cores to be gripped and are movable by a suitable drive (not shown) in the same way (arrow S) as the roll supporting means 50 of the central piece 10. As the roll cores WK weigh much less than the rolls, even if several superimposed roll cores are to be gripped by one core supporting means 40, it is sufficient to only grip the bottom one with the core supporting means. To ensure that the cores are still superimposed with an adequate stability, their circular end faces are suitably shaped and constructed for stable stackability, e.g. in stepped form or with sloping faces.

So that the core supporting means 40 are not in the way when the gripper is used for handling rolls, they are movable by a further drive out of the roll area. For this purpose they can e.g. be swung or folded against the gripper arm star 20 (arrow T) or can be displaced vertically upwards. To ensure that the core supporting means 40 when swung out does not radially project over the gripper arm star 20 and also so that in its swung down state it does not extend further downward than the central piece 10, it is advantageous to construct long core supporting means 40 designed for gripping core cylinders with heights greater than that of the number of rolls to be gripped in such a way as to be shortenable (arrow H), so that in an inoperative state (not moved away from the roll area, but carrying no roll cores) they do not project downward over the central piece 10. Thus, the central piece can carry the control sensors for all the downward movements of the gripper. The shortening of the core supporting means 40 can be driven by a separate drive (not shown), or by the drive for the movement S.

It is not necessary for core supporting means 40 to cooperate with corresponding holding means 60 in the core interior. They may also be constructed as jaws and pressed by drives against a substantially even inner surface of the cores. The embodiment cooperating with the holding means suggests itself because the cores can also be fixed to the winding stations and to the roll changers with the aid of such internal holding means.

The various drives necessary for the movements of the gripper parts are advantageously pneumatic or hydraulic linear drives. For controlling or checking the movements, sensors are required whose function will be described hereinafter and for which it is possible to use commercially available end, range and pressure sensors (depending on the function).

The gripper functions in the following way:

For gripping the maximum number of rolls (with vertical rotation axes): the gripper hanging on the conveying means with gripper arm star 20 resting on lower stop 11.2 is moved by the conveying means above the corresponding storage location and lowered towards it. Clamping means 30 are in their outermost positions (shown in broken line form), core supporting means 40 (shown in broken line form, in the swung-away position) are moved out of the way of the roll to be gripped, the roll supporting means 50 are positioned (position shown in broken line form) so that the central piece diameter allows its introduction into the central roll cores. As soon as a roll passes into the area of a sensor S1, shown as having a conical sensor beam, the downward movement is slowed down. Central piece 10 moves slowly into the roll core until gripper arm star 20 rests on the roll stack and consequently moves against the upper stop 11.1. The signal of an end sensor S2 installed in the vicinity of the upper stop stops the downward movement. Clamping means 30 are then moved inward until they firmly engage the roll or rolls W. The roll supporting means 50 are swung out. Advantageously, the movements of the corresponding parts are monitored by corresponding sensors. If the corresponding sensors supply a signal which confirms the clamping of the clamping means 30 and the corresponding position of the roll supporting means 50, the gripper is moved upward, first slowly until the sensor S2 indicates a spacing between the gripper arm star 20 and the upper stop 11.2, and then more rapidly.

For gripping a smaller number than the maximum number of rolls, the function is as described hereinbefore until the central piece 10 reaches the interior of the core. It does not pass far enough into the roll stack to allow the gripper arm star 20 to rest thereon (signal of sensor S2); but far enough for a corresponding sensor S7 positioned on the lower part of the central piece 10 (cf. FIG. 3) to enter a core. The downward movement then stops and the clamping operation begins.

For setting down one or more rolls: the gripper with the rolls is moved above the corresponding storage location and lowered until the sensor S1 indicates a stack or the floor. The downward movement is slowed down until the rolls rest upon a stack or floor and the gripper arm star 20 is moved against the upper stop 11.1 (signal of sensor S2), and then stopped. Clamping means 30 are moved outward, roll supporting means 50 are swung in and the gripper is again slowly moved upward until the deposited rolls leave the area or range of the sensor S1 whereupon the movement can be accelerated.

For gripping a maximum number of superimposed empty roll cores (rosette): the gripper is moved by the conveying means above the corresponding storage location and lowered. Clamping means 30 are in their outermost position, roll supporting means 50 are in their inner position, the core supporting means 40 are directed downward from the gripper arm star 20, but are neither extended nor spread out.

If sensor S1 indicates a core arrangement or rosette, the downward movement is decelerated and when gripper arm star 20 rests on this arrangement (signal of the sensor S2), the downward movement is stopped. Core supporting means 40 are extended downward into their longest position and spread. When corresponding sensors indicate the position (continuous line position), the gripper is moved upwards again slowly until the gripper arm star 20 moves away from the upper stop 11.1 and then with the normal speed.

For taking up a few cores: the taking up of less than the maximum number of superimposed cores can take place in the same way as the taking up of less than the maximum number of rolls, i.e., using a sensor fitted at a corresponding height on the central piece 10 and stopping the downward movement. For each desired number a special sensor must be provided. Sensors can also be positioned on core supporting means 40 for the same function. Core supporting means 40 must then be in their longest possible extended, but not spread, position during the downward movement of the gripper. By spreading out and subsequent, corresponding shortening of core supporting means 40, any number of cores can be secured between gripper arm star 20 and the spreading means of core driving arrangements 40.

For depositing cores, the function is the reverse of that for taking them up.

The sensor S1 has different functions and must therefore be appropriately designed or selected. Its signal is used for slowing down the downward movement of the gripper if a stack of rolls, an arrangement of cores or the floor comes into its range. Conversely, its signal can be used for accelerating the upwards movement to normal speed, when these items have left its range. If the empty gripper is erroneously lowered to the floor, the same sensor must supply an emergency stop signal when the gripper touches the floor. It is also advantageous for safety reasons to monitor with a pressure sensor S4 the pneumatic or hydraulic pressure operating the drives in the vicinity of the corresponding connection.

Figure 3:
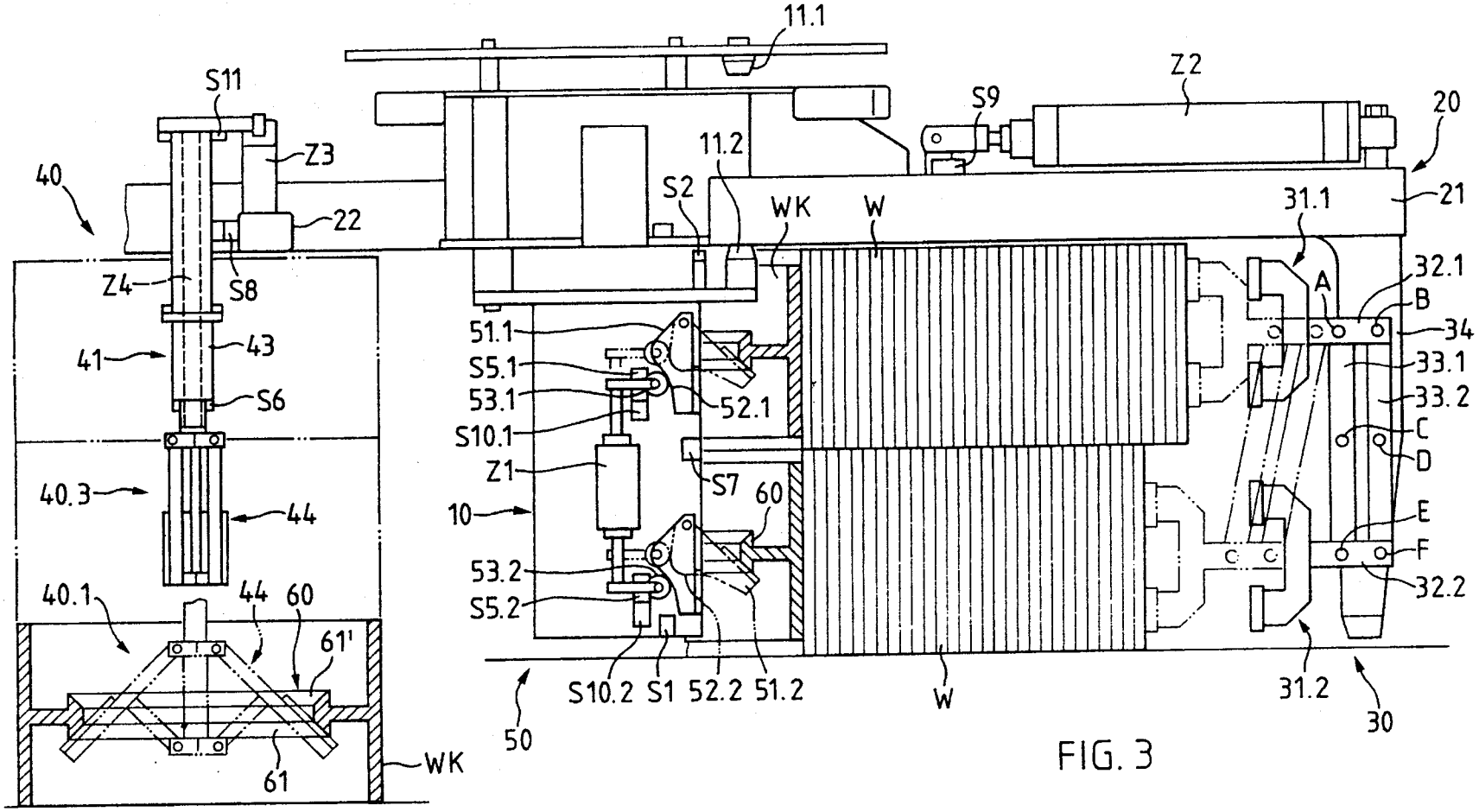
FIG. 3 is a view similar to FIG. 2 of a further embodiment of a gripper in accordance with the invention.
Figure 4:
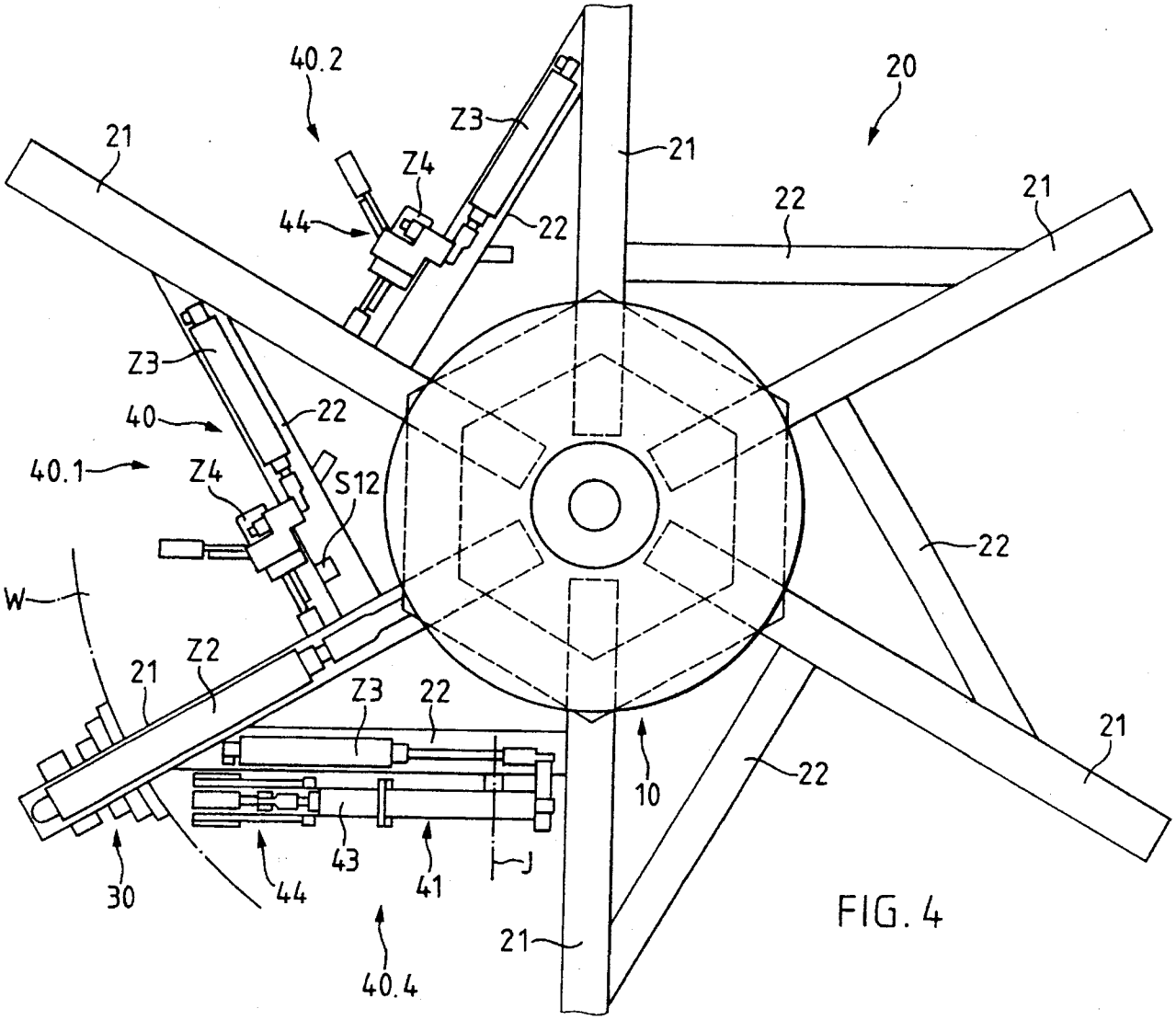
FIG. 4 is a more detailed end view of the gripper of the apparatus of FIG. 3.

FIGS. 3 and 4 show in detail another embodiment of the inventive gripper, in a section corresponding to FIG. 2 (FIG. 3) and as a plan view (FIG. 4). It is a gripper able to grip a pair of superimposed rolls even though the diameters of the two rolls of the pair differ from each other within a given range, or a single roll. This embodiment of the inventive gripper is also able to grip a rosette of e.g. six cylinders of three superimposed cores each. The function of the gripper is essentially the same as the more general gripper functions already described in conjunction with the preceding drawings. The parts of the gripper which have the same function as described hereinbefore are given the same reference numerals.

The gripper essentially comprises a central piece 10 and a six-arm gripper arm star 20 attached to the central piece and axially movable between the stops 11.1 and 11.2. The position of gripper arm star 20 relative to central piece 10 is monitored by sensor S2 in the vicinity of lower stop 11.2.

To each gripper arm 21 is fitted a clamping means 30, which is moved radially by the linear drive Z2. Drive Z2 is shown in its completely inserted position, which corresponds to the outermost position of clamping means 30. Clamping jaws 31.1 and 31.2 are pivotally fixed to a sliding lever 34 by means of rocking levers 32.1, 32.2 and 33.1, 33.2 and pivot pins A, B, C, D, E and F, so that if the rolls to be gripped have different diameters, the clamping jaws can be pivoted from their vertically superimposed position (shown in continuous line form) into a pivoted position (shown in broken line form). The position of sliding lever 34 is monitored by sensor S9 at its end operatively connected to drive Z2.

Roll supporting means 50 essentially comprises two groups of three driving flaps 51.1 and 51.2 each, which driving flaps are provided with movement or motion templates 52.1 and 52.2 in such a way that they are swung out if rollers 53.1 and 53.2, which are operatively connected to a drive Z1, are moved upwards. When rollers 53.1 and 53.2 move back, driving flaps 51.1 and 51.2 are no longer held in their swung out position and are moved back into their inner position by holding means 60 of the roll cores WK during the upward movement of the central piece 10. In order that the return movement can take place uniformly and in a jerk-free manner, it is advantageous to construct the roll core holding means 60 in such a way that they form a surface 61, which defines a truncated conical envelope coaxial with the core cylinder and which tapers inwardly upward. In order to permit roll cores to be gripped in either orientation, it is advantageous to arrange the holding means centrally in the hollow cylinder and to provide it with two mirror-image surfaces 61 and 61'. Holding means 60 can extend uninterruptedly around the inner circumference of the hollow cylinder, or can be interrupted.

The position of the driving flaps 51.1 and 51.2 is monitored by sensors S5.1, S5.2 and S10.1, S10.2. Sensors S1 and S7 with the above-described functions are also fitted to the central piece 10.

Core supporting means 40 are fixed to intermediate arms 22, which are positioned between the arms 21 of the gripper arm star 20. FIGS. 3 and 4 show four of a total of six such arrangements 40, namely 40.1 and 40.2, in the completely extended and spread apart position; 40.3 (FIG. 3) in the vertically upwardly directed unextended and not spread position; and 40.4 in the folded-in position, as assumed for the handling of rolls.

The core supporting means 40 has a drive Z3, which is located in the intermediate arm 22 and which pivots a core support 41 about an axis J (FIG. 4) in such a way that with the drive Z3 extended the core support is located parallel with the intermediate arm 22 (40.4), and when the drive is retracted the core support is oriented vertically downward (40.1, 40.2, 40.3). The core support 41 essentially comprises a telescopic tube 43, a spreading device 44, typically with three spreading legs, and a drive Z4, which lengthens to extend the telescopic tube 43 and spread the spreading device 44 and retracts to fold in the spreading device and shorten the telescopic tube. Here again, as a result of the core weight, when the telescopic tube is to be shortened, the spreading device is first folded in and only then is the telescopic tube shortened. The positions of the drives are monitored by sensors S8, S12, S6 and S11.

Figure 5:
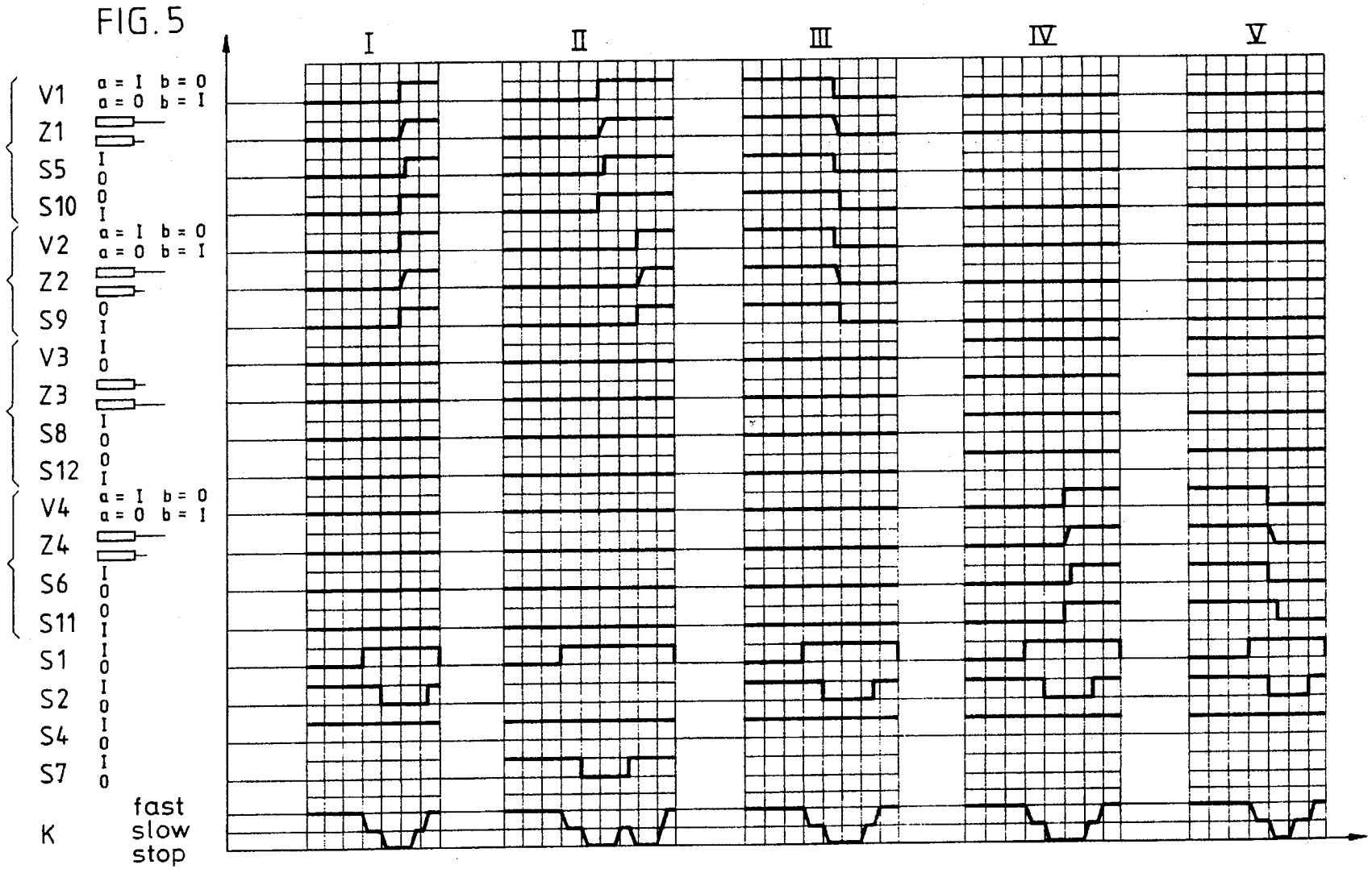
FIG. 5 is a diagram illustrating the operation of the gripper of FIGS. 3 and 4.

FIG. 5 is a diagram showing the function of the gripper according to FIGS. 3 and 4. Columns I to V relate to different operations (I: grip two rolls, II: grip one roll, III: set down rolls, IV: grip core rosette, V: set down core rosette). At the bottom of the Figure the modes of the up or down movement of the crane K are illustrated also. These are: fast, slow and stop. V1, V2, V3 and V4 represent valves for controlling the drives. For safety reasons, drives Z1, Z2 and Z4 have valve arrangements which instantaneously lock the drives in the assumed position in the case of a power failure.

What is claimed is:

1. A gripper with a roll handling configuration for handling at least one printed product roll, including a roll core or a plurality of superimposed roll cores each with printed products wound thereon, and a core handling configuration for handling a plurality of empty roll cores arranged in a rosette-shaped arrangement of juxtaposed roll cores or of juxtaposed cylinders of a plurality of vertically superimposed roll cores, the gripper comprising a central support;

a plurality of radially extending arms;

a plurality of roll clamping means carried by said radially extending arms for clamping a periphery of the printed product roll having a substantially vertical axis of rotation, said clamping means substantially forming a first circle within which said roll to be gripped is positioned, said clamping means being radially movable relative to said arms between a radially outermost position and a radially innermost position; and a plurality of core supporting means each for gripping the rosette-shaped arrangement comprising a plurality of the juxtaposed roll cores each having a vertical axis of rotation, said core supporting means being movable in said core handling configuration to form a second circle within said first circle formed by said clamping means in said radially outermost position, said core supporting means being movable in said roll handling configuration of the gripper away from said first circle formed by said roll clamping means in any possible position.

2. A gripper according to claim 1 wherein said core supporting means are pivotable between a core handling position substantially perpendicular to the radially extending arms and a vertical roll handling position substantially in a plane of the radially extending arms.

3. A gripper according to claim 1, wherein each said core supporting means includes a plurality of swinging arms and means for swinging said arms to a spread position engaging a central opening of a core.

4. A gripper according to claim 3, wherein each said core supporting means includes a telescopically extendable support tube supporting said swinging arms for selectively engaging one or more said cores.

5. A gripper according to claim 4 and including a first drive for said movement of each said core supporting means between a core handling position and roll handling position and a second drive for each telescoping and swinging arm movement of said core supporting means.

6. A gripper according to claim 1 and including central roll supporting means on said central support for engaging and supporting the core of a clamped roll.

7. A gripper according to claim 6, wherein said central roll support means includes a plurality of pivotally movable flaps on said central support, a cam attached to each said movable flap, and drive means including a roller for engaging said cams and pivoting said flaps to an extended position in which an interior of a core of the printed product roll is engaged and supported by said flaps.

8. A gripper according to claim 1 wherein said roll clamping means is arranged for gripping more than one printed product roll, each said clamping means includes a set of vertically separated clamping jaws for clamping a plurality of stacked printed product rolls, and rocking levers pivotally interconnecting clamping jaws of a set so that the jaws of a set can concurrently clamp printed product rolls having different outside diameters.

9. A gripper according to claim 1 and including sensors for monitoring a position of the gripper and of the core supporting means.

* * * * *